United States Patent [19]

Abell

[11] 4,133,367

[45] Jan. 9, 1979

[54] INSULATING WINDOW AND DOOR CONSTRUCTION

[75] Inventor: Irwin R. Abell, Portland, Oreg.

[73] Assignee: Temp-Rite, Inc., Portland, Oreg.

[21] Appl. No.: 767,500

[22] Filed: Feb. 10, 1977

[51] Int. Cl.[2] ..... E06B 3/30

[52] U.S. Cl. ..... 160/368 R; 160/354; 160/369; 160/392

[58] Field of Search ..... 160/354, 368 R, 369, 160/371, 392, 394, 395, 397, 349 R; 52/222, 273, 397, 402, 403, 202, 498, 502

[56] References Cited

U.S. PATENT DOCUMENTS

| | | | |
|---|---|---|---|
| 2,386,151 | 10/1945 | Trautvetter | 52/403 |
| 2,496,910 | 2/1950 | Fridolph | 160/395 |
| 2,701,041 | 2/1955 | Toth | 52/398 |
| 3,012,642 | 12/1961 | Emmerich | 52/403 |
| 3,310,923 | 3/1967 | De Ridder | 52/502 |
| 3,371,702 | 3/1968 | Keegan et al. | 160/395 |
| 3,475,870 | 11/1969 | Birum, Jr. | 52/498 |
| 3,487,601 | 1/1970 | James | 52/498 |
| 3,855,642 | 12/1974 | Blitch | 160/349 R |

*Primary Examiner*—Peter M. Caun

*Attorney, Agent, or Firm*—Klarquist, Sparkman, Campbell, Leigh, Hall & Whinston

[57] ABSTRACT

A window construction includes longitudinally channeled framing strips of right angular cross section attached to the four faces of a window casing or to a storm door window opening. Boundary edge portions of a pane closing the window opening are attached to the framing strips by resilient angular bead strips. The pane may comprise either a flexible plastic membrane, a rigid or semi-rigid self-supporting sheet or screening. The bead strips include two long bead flange portions extending at generally right angles from a body portion and a short rib portion extending from the outside corner at the intersection between the two bead flange portions. The rib portion and one bead flange portion are squeezed into opposed grooves in the channel portion of a framing strip to compress the pane in position against at least one inside surface of the framing strip.

4 Claims, 7 Drawing Figures

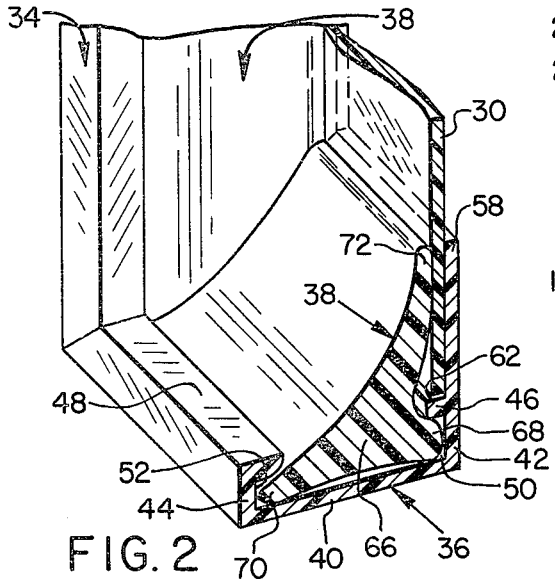
FIG. 2
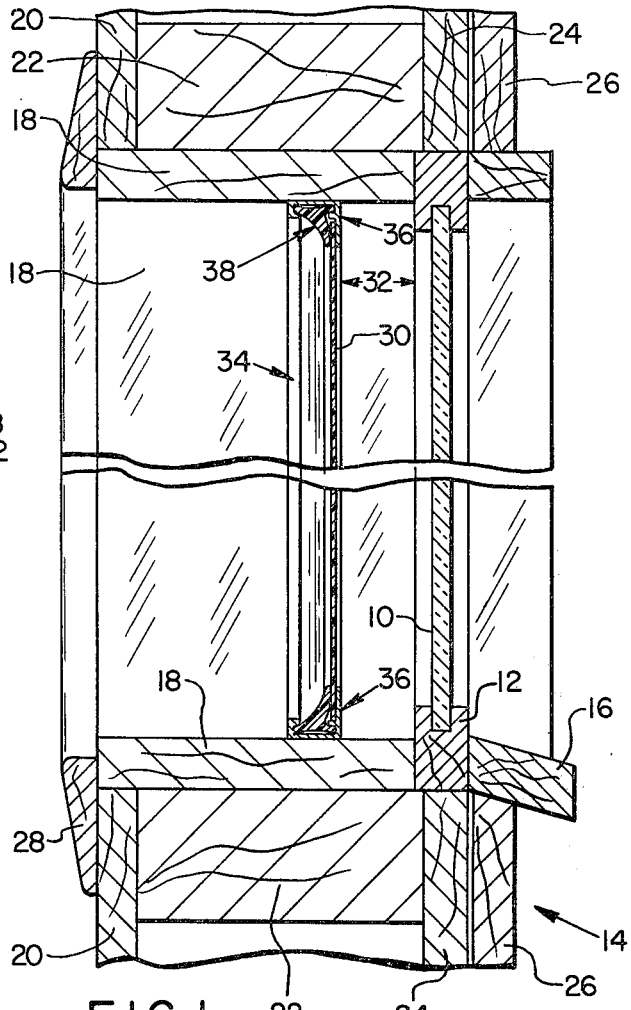
FIG. 1
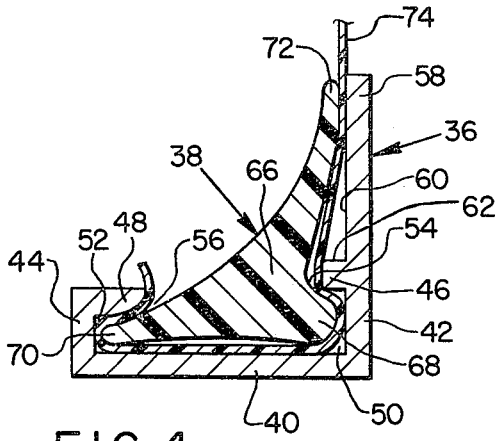
FIG. 4
FIG. 5
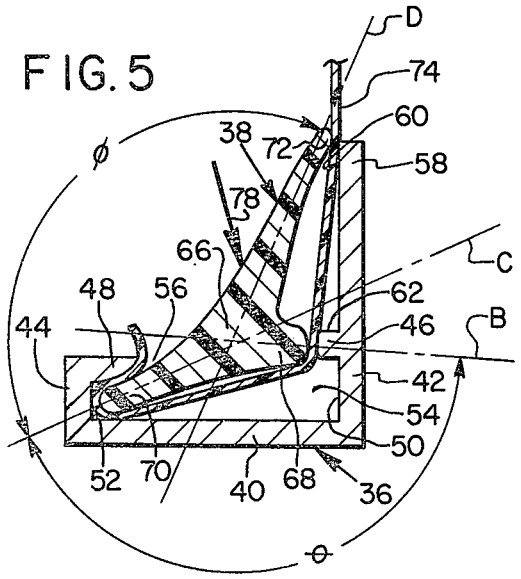
FIG. 3
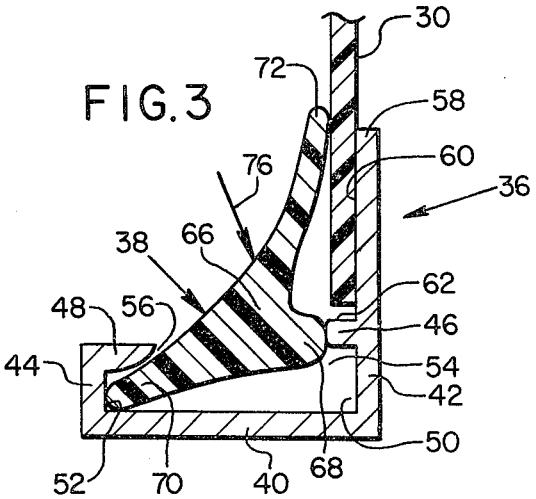

INSULATING WINDOW AND DOOR CONSTRUCTION

BACKGROUND OF THE INVENTION

The present invention relates to a window or door construction and more particularly to a window or door frame which may be utilized to mount a window or door pane of either a rigid or semi-rigid self-supporting material or a flexible plastic membrane in parallel spaced relation to an existing window glass or door panel to provide an insulating layer of air between the glass or panel and the pane.

Insulating windows and doors of various designs are widely used to conserve energy by preventing the escape of heat through windows and doors of residences and businesses. Because the use of such windows is seasonal, it is desirable for panes used in such insulating windows and doors to be inexpensive and to be easily installed and removed. It is also desirable that they not substantially detract from the appearance of the building on which they are used.

Various storm window and door constructions have been used in the past. In such constructions a pane is attached to a window or door frame in parallel spaced relation to the pane of window glass or door to provide a layer of dead air between the glass or door and the pane for insulating against cold or heat.

Where flexible plastic membrane type panes are used, these are commonly secured to the outside of a window frame by wooden strips nailed into the window frame. These have proved unsatisfactory because the wood strip is usually made of poor quality lath which often splinters or splits when nailed in place. Such wood strips are also unsightly and detract from the appearance of the building. More recently plastic membrane type panes have been mounted in window frames by rigid framing strips of the type disclosed in my prior U.S. Pat. No. 3,991,806 and the references cited therein. These prior art framing strips, while a substantial improvement over wooden lath, are only suitable for the installation of flexible plastic membranes and cannot be used to install rigid panes. The latter are easier to handle and install, and are stronger than flexible plastic membranes.

Another prior construction includes framing strips permanently secured in window frames or in storm doors to mount rigid or semi-rigid panes. For support, such rigid panes typically are mounted in a metal sash or frame which mates with the door or window framing strips. The necessity of such a sash adds to the weight and expense of the construction and makes it impossible to utilize the framing strips for mounting panes or screening not having a compatible sash. In the case of storm doors, a sash-mounted pane or screen is typically held in place by metal clips attached by screws to the storm door. The sash-mounted storm door panes and screening are typically interchangeable so that the door may be used alternatively as a storm door during cold weather and as a screen door during warmer weather. This door construction is relatively expensive as compared to the present invention; and the installation of such sash-mounted panes and screens is time consuming and requires the use of tools.

Attachment means which serve equally well for securing the edges of either an unframed rigid pane or an unframed flexible plastic membrane are heretofore unknown.

SUMMARY OF THE INVENTION

The present invention is a window construction which includes a rigid, angled and channeled framing strip and a flexible, resilient angled bead strip which snaps into the framing strip for simplifying the installation of a flexible or rigid pane or screening in either a window or door opening. The construction is especially useful to mount a second pane to provide an insulating window or door and does not require the use of sash-mounted panes or screens.

The main feature of the window construction of the present invention is its ability to secure either a rigid pane, such as one of glass or Plexiglas, or a flexible membrane, such as a sheet of clear plastic, in a window or door opening.

The framing strips of the invention are especially adapted for installation on the flat face of a window casing or storm door. They have a low profile and attractive appearance so as not to detract from the overall appearance of the window or storm door on which they are mounted.

A particular feature of the framing strips and bead strips of the invention is a sturdy construction which enables them to be used many times.

Other features include a pair of opposed longitudinal grooves in each framing strip and a rib and first bead flange on the bead strip which enable the bead strip to be snapped into the grooves of the framing strip and there held in place while a second bead flange holds a boundary edge of the pane in contact with a support flange of the framing strip.

A primary object of the invention is to provide an improved storm window construction with means for securing either flexible membranes or rigid self-supporting sheets in a window opening or in an opening of a storm door.

Another object is to provide an improved storm window construction which is inexpensive and quick and easy to install.

Another object is to provide an improved storm window construction as aforesaid which can be used with a wide variety of window and door types and which can secure a pane to either a facing surface extending perpendicularly to the window glass or door or to other flat window or door frame surfaces.

Another object is to provide an improved storm window construction as aforesaid which is attractive in appearance when installed and which can either be kept in place permanently or easily removed if desired.

Another object is to provide an improved storm window construction as aforesaid including reusable framing strips and bead strips and easily replaceable membranes or rigid panes.

Another important object is to provide an improved storm window construction as aforesaid with an improved framing strip and bead strip assembly which develops a strong resistance to pullout of the bead when a flat flexible plastic membrane is used as the window or door pane.

The foregoing and other objects, features and advantages of the present invention will be more apparent from the following detailed description which proceeds with reference to the accompanying drawings.

BRIEF DESCRIPTION OF THE DRAWINGS

In the drawings:

FIG. 1 is a cross-sectional view of a window assembly showing a rigid pane secured by a storm window construction in accordance with the present invention;

FIG. 2 is a perspective view of a cut-away portion of the storm window construction;

FIG. 3 is a partial cross-sectional view of the storm window construction showing installation of a rigid pane;

FIG. 4 is a partial cross-sectional view showing the construction securing a flexible membrane pane;

FIG. 5 is a partial cross-sectional view of the storm window construction showing installation of a flexible membrane;

DESCRIPTION OF THE PREFERRED EMBODIMENTS

Figure 7:
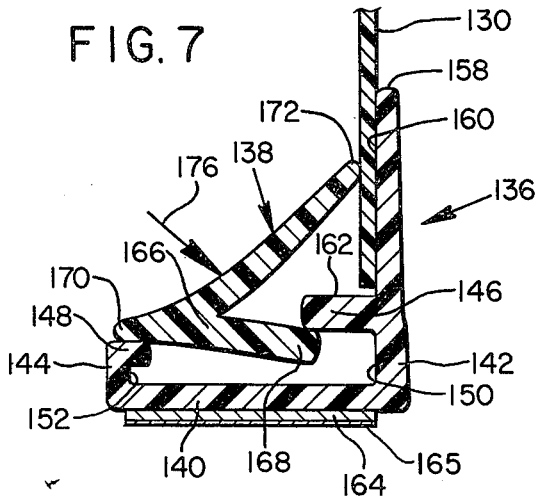
FIG. 7 is a view similar to FIG. 6 showing the assembly process of such embodiment.

With reference to FIG. 1, the window assembly includes a pane of window glass 10 set in a window frame or sash 12 secured in place near the exterior of a building 14 by a window still 16 outside the window frame, such sill and casing comprising the window framework. The casing 18 is supported at its inside edge by a vertical inside wall partition 20 and vertical outside wall partition 24. Horizontal framing members 22 extend between inside wall partition 20 and outside wall partition 24. The outside wall partition is covered with exterior siding 26. The inside edges of casing 18 are covered by a molding strip 28.

A clear storm windowpane 30 of a rigid self-supporting material, such as plastic or glass, extends across the window opening defined by the horizontal and vertical casing members 18 in parallel spaced relation to window glass 10 so as to confine an insulating dead air space 32 between windowpane 10 and storm window pane 30. The boundary edges of pane 30 are secured to the broad surfaces of casing member 18 by attachment means which include opposed vertical framing strips 34, opposed horizontal framing strips 36, and bead strips 38 which cooperate with such framing strips to secure pane 30 to the framing strips.

Framing strips 34 and 36 are preferably identical and made from a rigid metal material such as an aluminum alloy extrusion for durability. Rigid synthetic materials may also be suitable. Bead strips 38 are preferably a semi-resilient, flexible plastic or rubber material extruded in an elongated bead of uniform cross section.

Each framing strip 34, 36 includes a channel defined by a substantially flat base flange 40, inner and outer side flanges 42, 44 and, a ridge or first lip portion 46 and a second lip portion 48. The first and second lip portions 46, 48 project toward each other from the inner and outer side flanges 42, 44, respectively. The lip portions 46, 48 are in overlying spaced relation to base flange 40 to define first and second parallel, longitudinal grooves 50, 52, the second lip portion 48 and outer side flange 44 together comprising a hook. It is preferred that second lip portion 48 project further from the outer side flange than first lip portion 46 projects from the inner side flange so that groove 52 is deeper than groove 50. Grooves 50, 52 are opposed and open inwardly toward each other at first and second groove entrance openings 54, 56.

A support flange 58 extends outwardly from the channel at a right angle to base flange 40 and in the same general direction as side flanges 42, 44. Support flange 58 has a guide surface 60 which faces the inside of the angle formed between base flange 40 and support flange 58 to engage one face of a rigid storm window pane 30 along its boundary edge. Preferably, at least a portion of this surface is perpendicular to base flange 40 so that a large area of the support flange engages pane 30. In the illustrated embodiment, support flange 58 is an outward extension of inner side flange 42. While this location of the support flange is preferred for its simplicity, other arrangements would also be suitable. For example, the support flange could extend from the outer end of first lip portion 46; or first lip portion 46 could, itself, engage a boundary edge of pane 30 and thus serve as all or a portion of the support flange.

Framing strips 34, 36 also include a shelf means 62 which is an upper surface of lip 46 extending outwardly of guide surface 60. Shelf 62 is preferably perpendicular to guide surface 60 and positioned to abut an end edge of a rigid pane 30 when such a pane is positioned against guide surface 60, as shown in FIG. 2. A shelf separate from lip portion 46 could, alternatively, be used. In either case lips 46, 48 should not be positioned farther from base flange 40 than shelf means 62. This ensures that the limits of the window or door opening defined by such lips provide sufficient clearance to insert rigid pane 30 into the window opening and against guide surfaces 60 adjacent to shelf 62.

The bead strip 38 preferably includes a central body portion 66, a short rib portion 68, and longer first and second flange portions 70, 72. The rib and bead flange portions radiate in different directions from the body portion 66 with the bead flange portions tapering at their free ends. Rib portion 68 can be snapped into first groove 50 after first bead flange portion 70 is inserted in second groove 52 of the framing strip to retain the bead strip in the channel of the framing strip. The rib and bead flange portions are positioned in relation to each other such that when the rib and first bead flange portions 68, 70 are within grooves 50, 52, respectively, and pane 30 is engaging guide surface 60, second bead flange portion 72 engages and exerts pressure against a face of pane 30, to hold it in contact with guide surface 60.

Rib portion 68 extends opposite first bead flange portion 70 from the outside corner formed at the intersection of the bead flange portions. FIG. 5 shows such a bead flange with rib portion 68 and first and second bead flange portions 70, 72 longitudinally bisected by planes B, C, D, respectively. These planes intersect at or lie parallel to the longitudinal axis of central body portion 66. When the bead strip is relaxed, an angle $\phi$ between planes C and D should be at least slightly greater than the angle between base flange 40 and support flange 58 of the framing strip. This enables bead flange 72 to exert a clamping pressure against pane 30 when the bead strip is installed in the channel of the framing strip. An angle $\theta$ between planes B and C is preferably greater than ninety degrees so that rib and first bead flange portions 68, 70 can be retained in grooves 50, 52 by the free ends of lip portions 46, 48. Rib portion 68 projects a lesser distance from the intersection of planes B and C than does first bead flange portion 70 so that rib portion 68 may be easily snapped past first lip portion 46 during installation of a pane.

Framing strips 36, and bead strips 38 cooperate effectively also to secure a flexible plastic membrane 74 as the pane if desired. Such a flexible pane 74 does not terminate at shelf means 62 as does a rigid pane. Instead, a bight of pane 74 continues around rib and first bead flange portions 68, 70 as shown in FIGS. 4 and 5. The bight is wedged or otherwise held in channel grooves 50, 52 of the framing strip by resilient bead strip 38 to secure the membrane in tension.

Neither second bead flange 72 of bead strip 38 nor support flange 58 are absolutely required when the attachment means of the present invention are used for securing flexible membrane 74. These elements are useful, however, for tensioning a flexible membrane and are essential if the attachment means are to be used alternatively for securing a rigid pane.

OPERATION

The pane securing function is the same for both vertical and longitudinal framing strips 34, 36 as shown and described.

In practice, the framing strips fasten to flat side, top and bottom surfaces of casing member 18 with their first lip portions 46 extending outwardly away from the storm door or existing window glass. If the pane is to be used to trap an insulating layer of air in a window opening, the framing strips should be positioned parallel to and spaced equally from window glass 10, on either side of the glass. If the pane is to trap air in a door opening the framing strips should be mounted on a storm door which is positioned in the door opening.

The framing strips may be provided in long lengths and then cut to desired shorter lengths by the user for installation, depending on the size of the window or door opening. The bead strips may be provided in similar long lengths for cutting to size. This would enable the assembly to be sold in a package to accommodate window or door openings of various sizes.

If a rigid, self-supporting pane 30 is to be installed, it is cut so that the dimensions of its boundary edges are slightly less than the dimensions of the window or door opening defined by shelf 62 of the framing strips. The window is next installed in the opening so the boundary edges of one flat face of pane 30 engage guide surfaces 60 as shown in FIGS. 2 and 3.

One of the four bead strips 38 is then inserted in one of the four framing strips according to the following steps. First, bead flange portion 70 is inserted in second groove 52 as shown in FIG. 3. Next, pressure is exerted on the outer surface of central body portion 66 of the bead strip at a position between first and second bead flange portions 70, 72 as shown by arrow 76 to snap rib portion 68 past short lip portion 46 into channel groove 50. Bead strip 38 is thus secured within the framing strip channel with second bead flange portion 72 pressing pane 30 against guide surface 60.

The foregoing procedure is repeated along the remaining three boundary edges of pane 30 to secure the pane in the window opening against the remaining three framing strips.

To install flexible membrane 74, the pane is cut to the approximate size of the window or door opening, but slightly over size. A bight of pane 74 along one of its boundary edges is inserted into the channel of one of the four framing strips surrounding the window or door opening. Then first bead flange portion 70 of a bead strip is inserted into second groove 52 of the channel. Next, pressure is applied to a central body portion of the bead strip at a point between first and second bead flange portions 70, 72 as shown by arrow 78 in FIG. 5 to snap rib 68 past short lip portion 46 into channel groove 50 and thereby secure the bight between rib portion 68 and the inner walls of channel grooves 50, 52. With an edge of flexible pane 74 thus secured, second bead flange 72 presses pane 74 against guide surface 60.

Flexible pane 74 is then pulled across the window opening toward the opposite frame strip and a free opposite edge portion of the pane is wrapped partially around a bead strip. Then the rib and first bead flange portions of such bead strip are pressed into the channel grooves of such framing strip as before, pulling flexible pane 74 taut across the window opening. Now the same procedure is repeated along the remaining opposed boundary edges of pane 74 to secure such edges within channels of the two remaining framing strips. With this complete, flexible pane 74 is stretched entirely taut across the window opening and secured firmly in place by the cooperating bead and framing strips.

An installed pane may be quickly removed from the window or door opening by pulling the bead strips out of the channels of the framing strips, and then lifting the pane out of the opening.

The attachment means of the present invention can also operate to secure screening in a window or door opening. If the screening is self-supporting, e.g., if it has a rigid border, it may be secured in the same manner as rigid pane 30. If, however, the screen is flexible rather than self-supporting, it can be secured in the same manner as flexible pane 74.

FIG. 6 Embodiment

Figure 6:
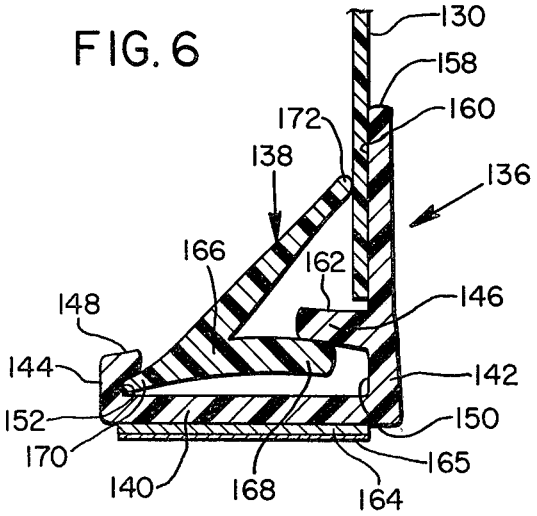
FIG. 6 is a partial cross-sectional view of an alternative embodiment of the invention.

An additional embodiment of the invention is shown securing a rigid pane 130 in FIGS. 6 and 7. This embodiment, which may be used to secure either a rigid pane or a flexible membrane, includes a framing strip 136 and bead strip 138.

The framing strip has a base flange 140, inner and outer side flanges 142, 144 and lip portions 146, 148 which define first and second grooves 150, 152. These features are identical to similarly named features previously described except that first lip portion 146 projects from inner side flange 142 a greater distance than the second lip portion 148 projects from outer side flange 144. Groove 150 is thus deeper than groove 152. Framing strip 136 also has a support flange 158 with a guide surface 160 and a shelf means 162. An adhesive strip 164 with a paper backing 165 is positioned on the outside of the base flange 140. When paper backing 165 is removed, framing strip 136 can be mounted in a window opening by pressing the pressure-sensitive adhesive strip 162 against the window frame.

Bead strip 138 includes a central body portion 166, a rib portion 168 and first and second bead flanges 170, 172. This strip differs from previously described bead strips in that its rib portion 168 projects a greater distance from the intersection of the first and second bead flange portions than does first bead flange portion 170; that is, rib 168 is longer than first bead flange 170. Preferably the distance between the outermost end of rib portion 168 and first bead flange portion 170 is less than the inside distance between inner and outer side flanges 142, 144 for ease of installation.

Because of the structural differences between the embodiment of FIGS. 3 and 6, the installation procedure differs slightly from the installation procedure previously described. Rib portion 168 is first inserted in first groove 150 as shown in FIG. 7 with rigid pane 130 in place. Next, inward pressure is applied to the outer surface of body portion 166 of the bead strip between the ends of first and second bead flanges 170, 172 at and in the direction of arrow 176. Under sufficient pressure, rib portion 168 slides further into groove 150 and first flange portion 170 snaps past short lip 148 into channel groove 52, securing the bead strip to the framing strip while bead flange 172 holds pane 130 against guide surface 160. This procedure is repeated along each edge of pane 130.

Having illustrated and described a preferred embodiment of my invention, it will be apparent to those skilled in the art that modifications and changes may be made without departing from my invention in its broader aspects.

I claim:

1. Attachment means for securing panes of various thicknesses, including rigid, semi-rigid and flexible panes, within an opening defined by a frame comprising:

a one-piece rigid framing strip of uniform cross section adapted for attachment to the sides of a frame, said strip including (a) a base flange;

(b) a support flange intersecting said base flange at 90° to form a corner;

(c) a hook at the free end of said base flange, which hook includes a lip portion extending inwardly toward said support flange in overlying spaced relation to said base flange, and a side flange connecting said base flange to said lip portion; and (d) a ridge on said support flange projecting toward said hook at a greater distance from said base flange than said lip portion;

and a resilient bead member sized and shaped to be removably retained by said framing strip, said member having a central body portion from which radiate exactly three protuberances including, when operative (a) a rib portion positioned inwardly of said ridge;

(b) a first bead flange portion positioned within said hook; and (c) a flexible second bead flange portion extending outwardly past said ridge to position only an outer end portion thereof in at least close proximity to the inner face of said support flange with the remainder of said second bead flange portion, inward of said outer end portion, being spaced a progressively increasing distance from said inner face in the direction toward said ridge such that said rib and first bead flange portions connect said bead strip to said framing strip and said outer end portion of said second bead flange portion exerts a compressive gripping force against panes of widely varying thickness inserted between said outer end portion of said second bead flange portion and said support flange.

2. Attachment means according to claim 1 constructed such that:

a pane consisting of a thin flexible membrane can be secured to said attachment means by wrapping a bight of a membrane around said bead member and subsequently installing said bead member into said framing strip, so that said bight extends between said second bead flange portion and said support flange, around the outermost end of said ridge, between said ridge and said rib portion, and around the outermost ends of said rib and first bead flange portions; and said rib portion is located in close proximity to said ridge, when said bead member is installed to secure said flexible membrane, so that tensioning of a portion of said membrane which extends outwardly from between said second bead flange and said support flange urges said rib portion against said ridge to grip said bight therebetween with a gripping pressure proportional to the tension on said outwardly extending portion of said membrane.

3. Attachment means according to claim 1 wherein:

said lip portion projects from said side flange a greater distance than said ridge projects from said support flange; and said first bead flange portion projects a greater distance from the intersection of said first and second bead flange portions than does said rib portion.

4. Attachment means according to claim 1 wherein:

said ridge projects from said support flange a greater distance than said lip portion projects from said side flange; and said rib portion projects a greater distance from the intersection of said first and second bead flange portions than does said first bead flange portion.

* * * * *